US012071830B2

(12) United States Patent
Alqurashi et al.

(10) Patent No.: US 12,071,830 B2
(45) Date of Patent: Aug. 27, 2024

(54) WELLBORE INTERVENTION SYSTEMS AND RELATED METHODS OF REPAIRING CEMENT FAILURES

(71) Applicant: Saudi Arabian Oil Company, Dhahran (SA)

(72) Inventors: Mahmoud Adnan Alqurashi, Dhahran (SA); Ahmed A. Alkuhaili, Al Khobar (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/903,865

(22) Filed: Sep. 6, 2022

(65) Prior Publication Data

US 2024/0076949 A1 Mar. 7, 2024

(51) Int. Cl.

| | |
|---|---|
| ***E21B 33/14*** | (2006.01) |
| ***E21B 33/12*** | (2006.01) |
| ***E21B 47/117*** | (2012.01) |

(52) U.S. Cl.

CPC ..... *E21B 33/12* (2013.01); *E21B 33/14* (2013.01); *E21B 47/117* (2020.05)

(58) Field of Classification Search

CPC ..... E21B 33/12; E21B 33/14; E21B 47/10; E21B 47/113; E21B 47/114; E21B 47/117

See application file for complete search history.

(56) References Cited

U.S. PATENT DOCUMENTS

| | | | | |
|---|---|---|---|---|
| 1,548,012 | A * | 7/1925 | Dunn | E21B 47/10 73/40.5 R |
| 2,187,275 | A * | 1/1940 | McLennan | E21B 47/04 166/173 |
| 6,668,936 | B2 | 12/2003 | Williamson, Jr. et al. | |
| 8,408,314 | B2 | 4/2013 | Patel et al. | |
| 9,121,255 | B2 | 9/2015 | Themig et al. | |
| 9,995,105 | B2 * | 6/2018 | Miller | E21B 33/13 |
| 10,718,181 | B2 | 7/2020 | Saldanha et al. | |
| 2021/0355808 | A1 * | 11/2021 | Volkov | E21B 47/117 |

* cited by examiner

*Primary Examiner* — Catherine Loikith

(74) *Attorney, Agent, or Firm* — Fish & Richardson P.C.

(57) ABSTRACT

A wellbore intervention system for repairing a wall failure within a wellbore includes a fluid conduit installed to an outer surface of a casing string within the wellbore. The fluid conduit includes a tube to which a remedial substance is delivered, multiple ports arranged along a length of the tube for communicating the remedial substance to the wall failure in a cement region along the wellbore, and a one-way valve for preventing a reservoir fluid at the wall failure from flowing in an uphole direction through the tube.

11 Claims, 3 Drawing Sheets

WELLBORE INTERVENTION SYSTEMS AND RELATED METHODS OF REPAIRING CEMENT FAILURES

TECHNICAL FIELD

This disclosure relates to wellbore intervention systems, such as a system of fluid conduits that are installed to an outer surface of a casing string for delivering a remedial substance to a cement wall failure.

BACKGROUND

During well construction and drilling operations, casing tubular is run subsurface and cemented in place to allow access to a desired depth, while isolating undesired, challenging formation regions and undesired reservoirs. Formation regions and reservoirs that are cemented behind one or more casings start to fail, resulting in an unacceptable casing-to-casing annulus (CCA) pressure. CCA pressure can compromise the integrity of the well and may need to be addressed once detected.

SUMMARY

This disclosure relates to wellbore intervention systems for repairing a failure at a cement wall region along a wellbore. The wellbore intervention system includes multiple fluid conduits that are installed to an outer surface of a casing string for delivering a remedial substance to the failure.

In one aspect, a wellbore intervention system for repairing a wall failure within a wellbore includes a fluid conduit installed to an outer surface of a casing string within the wellbore. The fluid conduit includes a tube to which a remedial substance is delivered, multiple ports arranged along a length of the tube for communicating the remedial substance to the wall failure in a cement region along the wellbore, and a one-way valve for preventing a reservoir fluid at the wall failure from flowing in an uphole direction through the tube.

Embodiments may provide one or more of the following features.

In some embodiments, the multiple ports are spaced substantially equidistantly along the length of the tube.

In some embodiments, the tube can withstand an internal fluid pressure of up to about 70 kPa.

In some embodiments, the one-way valve is a surface protection plug.

In some embodiments, the wellbore intervention system further includes one or more additional fluid conduits.

In some embodiments, the fluid conduit and the one or more additional fluid conduits are spaced apart around the outer surface of the casing string.

In some embodiments, the wellbore intervention system further includes a centralizer that presses the fluid conduit against the outer surface of the casing string.

In some embodiments, the wellbore intervention system further includes the remedial substance.

In some embodiments, the remedial substance includes cement.

In another aspect, a method of repairing a cement failure within a wellbore includes installing a fluid conduit to an outer surface of a first casing string, the fluid conduit including a tube, a port arranged along the tube, and a one-way valve. In some embodiments, the method further includes running the first casing string in a downhole direction through a second casing string installed at the wellbore, detecting a casing-to-casing annulus (CCA) pressure between the first and second casing strings, the CCA pressure being indicative of the cement failure. In some embodiments, the method further includes flowing a remedial substance through the conduit and out of the port to deliver the remedial substance to the cement failure.

Embodiments may provide one or more of the following features.

In some embodiments, the method further includes installing one or more additional fluid conduits to the outer surface before running the first casing string through the second casing string.

In some embodiments, the fluid conduit and the one or more additional fluid conduits are spaced apart around the outer surface of the casing string.

In some embodiments, the fluid conduit includes one or more additional ports.

In some embodiments, the tube can withstand an internal fluid pressure of up to about 70 kPa.

In some embodiments, the method further includes preventing a reservoir fluid at the cement failure from flowing in an uphole direction through the tube.

The details of one or more embodiments are set forth in the accompanying drawings and description. Other features, aspects, and advantages of the embodiments will become apparent from the description, drawings, and claims.

DETAILED DESCRIPTION

Figure 1:
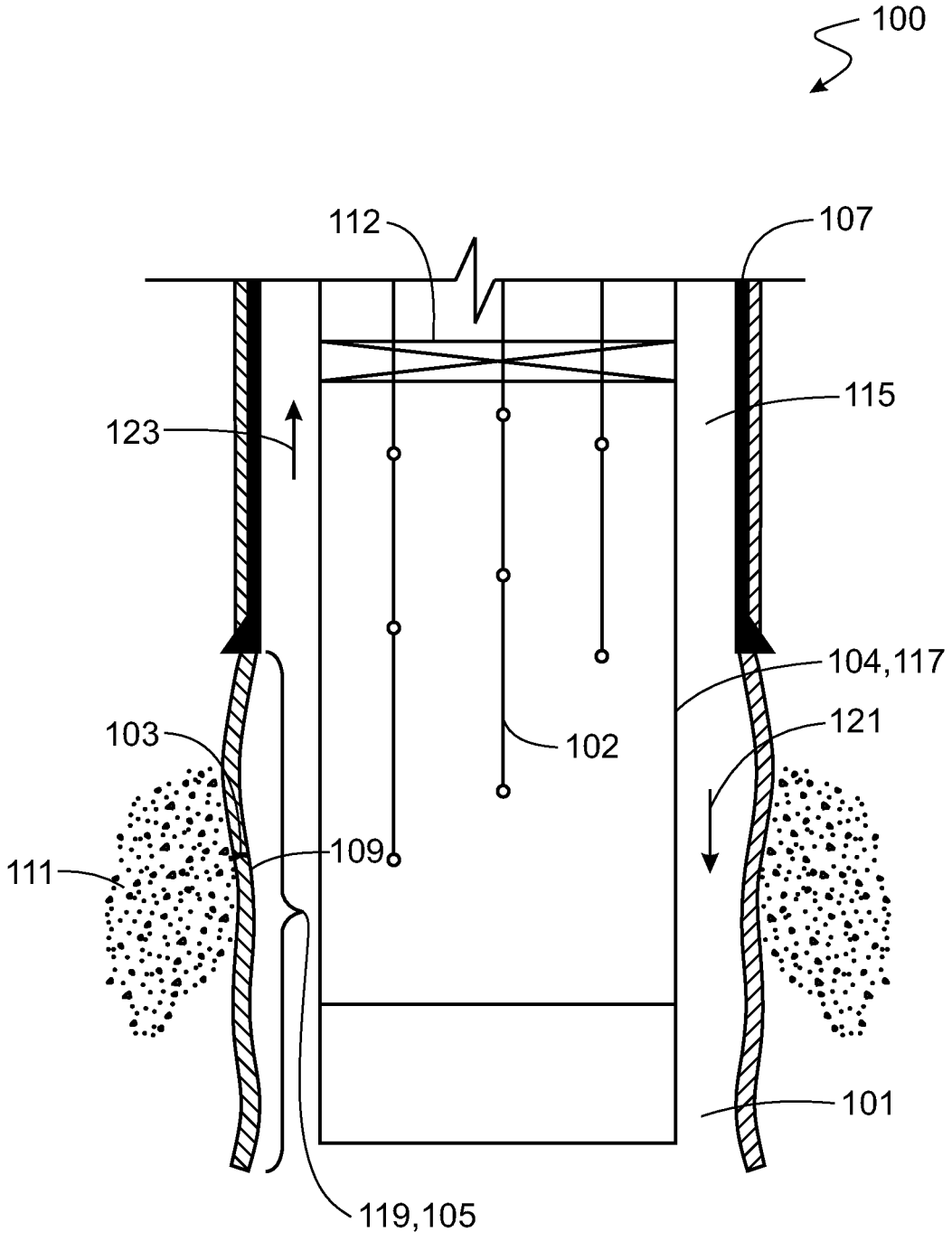
FIG. 1 is a diagram of an example wellbore intervention system installed to a casing string within a wellbore.

FIG. 1 illustrates an example wellbore intervention system 100 for delivering a remedial substance (e.g., a fluid, a fluid-solid mixture, or another type of fluid combination) to a compromised location along a wellbore 101 within a rock formation 111. In some embodiments, the compromised location is a failure 103 at a cement wall region 105 located behind (e.g., radially outward of) a casing string 107 along an open-hole section 119 of the wellbore 101. In some examples, the failure 103 is a crack, an opening, or another mechanical weakness or vulnerability at an inner surface 109 of the cement wall region 105. A failure 103 could consequently allow a reservoir fluid within the rock formation 111 to enter an annular region 115 (e.g., an annulus) between the casing string 107 and an inner casing string 117. A presence of the reservoir fluid within the annular region 115 could produce an undesirable fluid pressure (e.g., a casing-to-casing annulus (CCA) pressure) that may compromise a mechanical integrity of the outer and inner casing strings 107, 117. The wellbore intervention system 100 is designed to address such a result.

The wellbore intervention system 100 includes multiple fluid conduits (e.g., tubes) 102 for delivering the remedial substance in a downhole direction 121 from an uphole surface of the rock formation 111 to the failure 103. The wellbore intervention system 100 also includes a centralizer 112 that, in addition to centralizing the inner casing string 117 within the outer casing string 107, surrounds the fluid conduits 102 and presses the fluid conduits 102 against the inner casing string 117. In some embodiments, the centralizer 112 may include one or more clamps to attach the fluid conduits 102 to the inner casing string 117. The fluid conduits 102 are securely installed to an outer surface 104 of the inner casing string 117 and are designed to withstand a high-pressure, high-temperature environment of the wellbore 101. The fluid conduits 102 may be arranged equidistantly or non-equidistantly at intervals around the outer surface 104 for servicing a failure 103 at any circumferential position within the wellbore 101.

Figure 2:
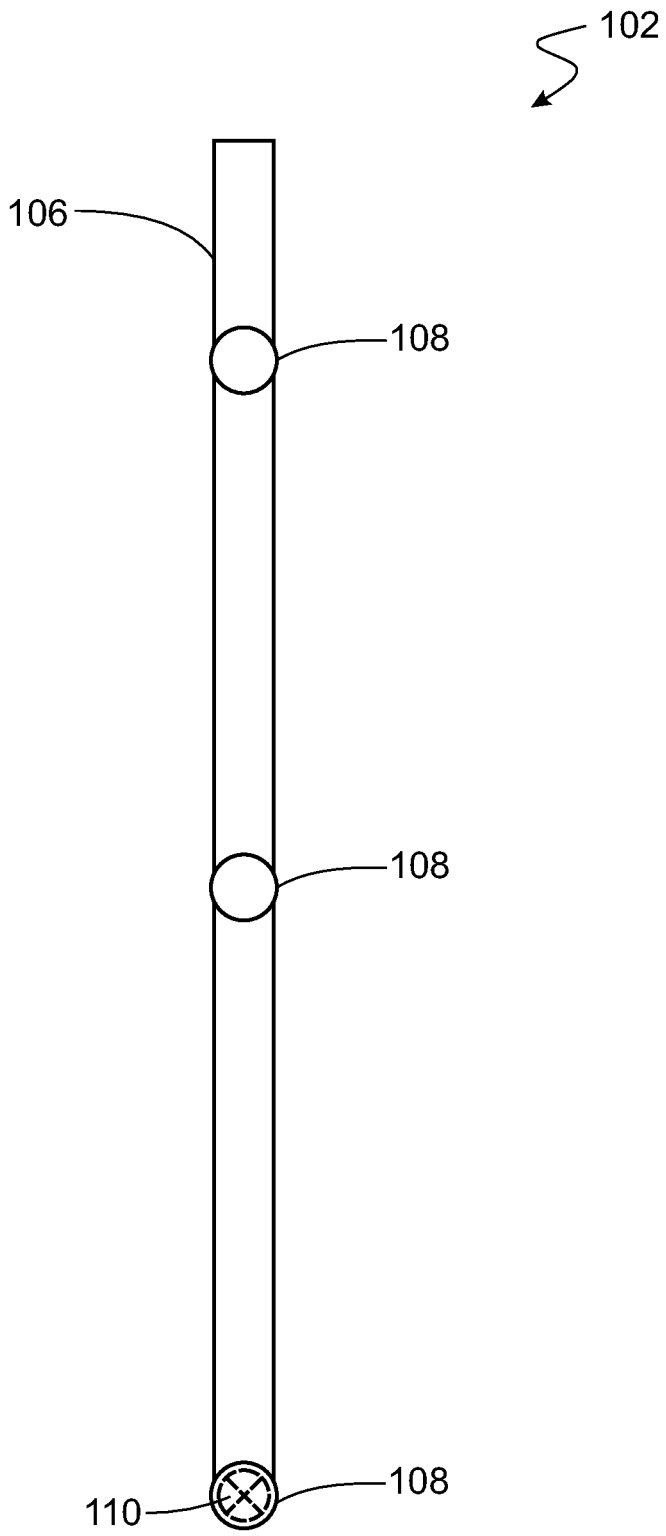
FIG. 2 is a side view of an example fluid conduit of the wellbore intervention system of FIG. 1.

Referring to FIG. 2, each fluid conduit 102 includes a tube 106, multiple ports 108 (e.g., defining openings) along the tube 106 through which the remedial substance can be delivered to the failure 103, and a one-way valve 110 (e.g., a check valve) that prevents the reservoir fluid from flowing in an uphole direction 123 towards the surface. In this way, the one-way valve 110 functions as a surface protection plug that further prevents any reservoir fluid from reaching the surface. The tube 106 extends from the uphole surface to a terminal port 108.

The ports 108 may be spaced equally or unequally along the length of the tube 106 for delivering the remedial substance in close enough proximity to a failure 103 located at any depth (e.g., axial position) along the open-hole section 119 of the wellbore 101. In some embodiments, the ports 108 may be arranged along the tube 106 at regular intervals of about 100 meters (m) to about 150 m. In some embodiments, each port 108 may have a diameter of about 0.03 centimeters (cm) to about 0.06 cm. In some embodiments, the tubes 106 are made of one or more materials, such as stainless steel or an alloy-enhanced material. In some embodiments, the tubes 106 can withstand an fluid pressure of up to about 70 kilopascals (kPa).

In some embodiments, the remedial substance is cement or another chemical selected to repair a cement failure (e.g., resin cement). In operation, the wellbore intervention system 100 is run with the inner casing string 117 to ensure that a mitigation measure is in place downhole. Therefore, upon detection of a threshold CCA pressure within the annular region 115 (e.g., indicating a weak bond within the cement wall region 105), the remedial substance is injected into one or more selected fluid conduits 102 at the uphole surface. For example, as illustrated in FIG. 1, downhole ends of the fluid conduits 102 are positioned at different depths along the inner casing string 117. Fluid is injected initially into the downhole-most conduit 102 and progressively injected into the next downhole-most conduit 102 (e.g., the conduit 102 just above) until all of the remedial substance is injected into the wellbore intervention system 100. The remedial substance then naturally flows in the downhole direction 121 due to a drawdown pressure near the failure 103 until it reaches the port 108 of least resistance (e.g., nearest to the failure 103). The drawdown (e.g., suction) pressure results from an opening at the failure 103 in the cement wall region 105, which fluidly communicates an interior region of the rock formation 111 with the annular region 115. The remedial substance flows out of the port 108 and to the failure 103 to deposit itself and thereby plug (e.g., close) any openings at the failure 103. In this manner, the remedial substance repairs the failure 103 to restore strength and mechanical integrity otherwise to the cement wall region 105. In some embodiments, each of the ports 108 is a single-use injection port.

In some embodiments, the wellbore intervention system 100 is installed to a casing string and deployed to a wellbore that is well-known, expected to have cement quality degradation presently, or anticipated to have cement quality degradation in the future. Advantageously, the wellbore intervention system 100 is a rig-less intervention system (e.g., therefore, avoiding a stoppage in production). Furthermore, installation of the wellbore intervention system 100 to a casing string does not interfere with conventional centralization of the casing string within a wellbore or impact conventional clearance or measurement parameters for installation. The wellbore intervention system 100 can be utilized with one or multiple casing strings within a wellbore. Additionally, the wellbore intervention system 100 is easy to install at a rig floor.

Figure 3:
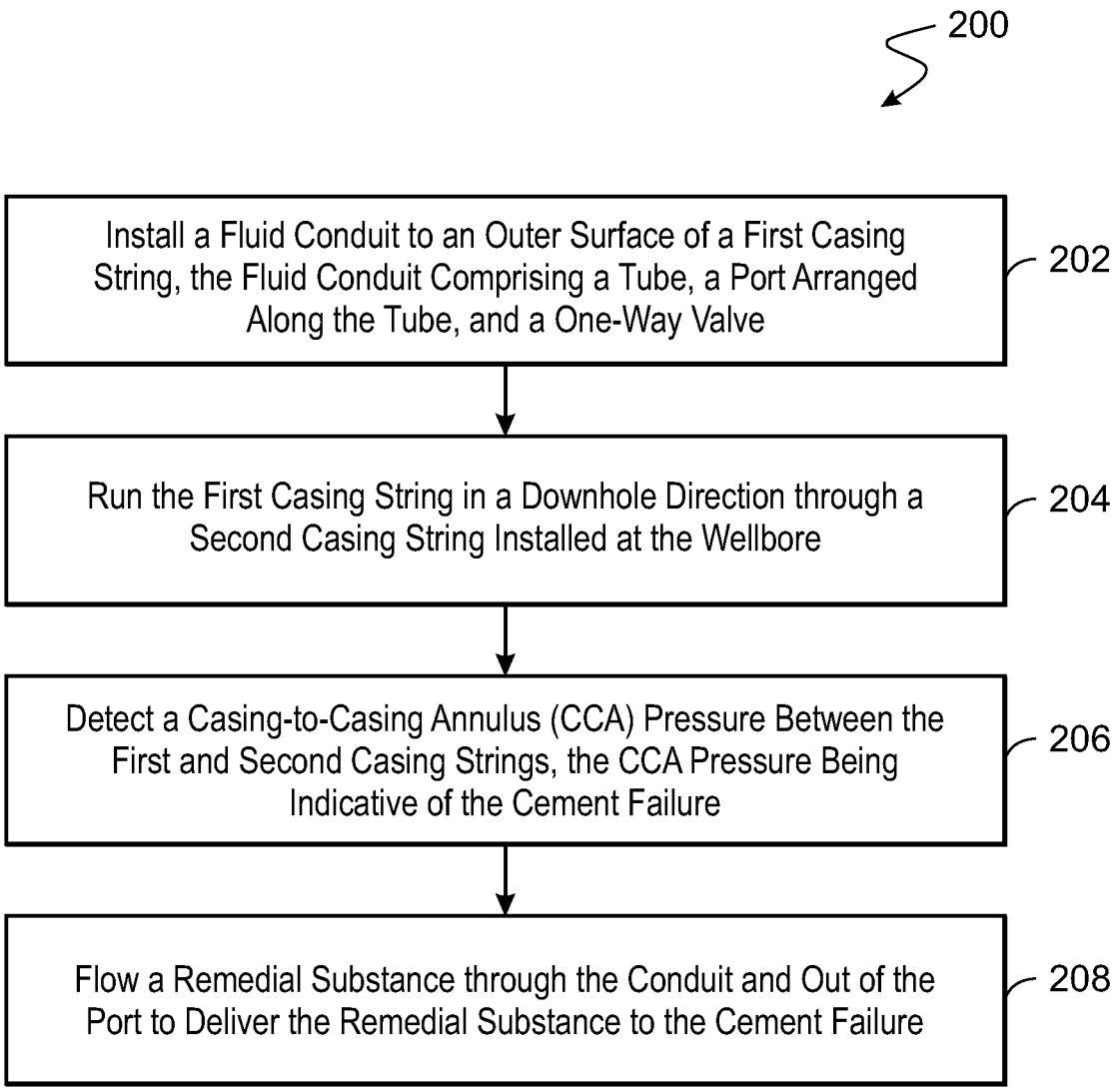
FIG. 3 is a flow chart illustrating an example method of repairing a cement failure within a wellbore using the wellbore intervention system of FIG. 1.

FIG. 3 is a flow chart illustrating an example method 200 of repairing a cement failure (e.g., the failure 103) within a wellbore (e.g., the wellbore 101). In some embodiments, the method 200 includes a step 202 for installing a fluid conduit (e.g., the fluid conduit 102) to an outer surface (e.g., the outer surface 104) of a first casing string (e.g., the inner casing string 117), the fluid conduit including a tube (e.g., the tube 106), a port (e.g., the port 108) arranged along the tube, and a one-way valve (e.g., the one-way valve 110) wellbore (e.g., the wellbore 101). In some embodiments, the method 200 includes a step 204 for running the first casing string in a downhole direction (e.g., the downhole direction 121) through a second casing string (e.g., the outer casing string 107) installed at the wellbore. In some embodiments, the method 200 includes a step 206 for detecting a casing-to-casing annulus (CCA) pressure between the first and second casing strings, the CCA pressure being indicative of the cement failure. In some embodiments, the method 200 includes a step 208 for flowing a remedial substance through the conduit and out of the port to deliver the remedial substance to the cement failure.

While the wellbore intervention system 100 has been described and illustrated with respect to certain dimensions, sizes, shapes, arrangements, materials, and methods 200, in some embodiments, a wellbore intervention system that is otherwise substantially similar in construction and function to the wellbore intervention system 100 may include one or more different dimensions, sizes, shapes, arrangements, configurations, and materials or may be utilized according to different methods. For example, in some embodiments, a wellbore intervention system that is otherwise substantially similar in construction and function to the wellbore intervention system 100 includes only a single fluid conduit 102 instead of multiple fluid conduits 102. In some embodiments, one or more fluid conduits 102 of a wellbore intervention system may include only a single port 108 instead of multiple ports 108.

Accordingly, other embodiments are also within the scope of the following claims.

What is claimed is:

1. A wellbore intervention system for repairing a wall failure within a wellbore, the wellbore intervention system comprising:

a first fluid conduit installed to an outer surface of a casing string within the wellbore, the first fluid conduit comprising:

a tube to which a remedial substance is delivered;

a plurality of ports arranged along a length of the tube for communicating the remedial substance to the wall failure in a cement region along the wellbore; and a one-way valve for preventing a reservoir fluid at the wall failure from flowing in an uphole direction through the tube; and one or more second fluid conduits, wherein the first fluid conduit and the one or more second fluid conduits are spaced apart around the outer surface of the casing string.

2. The wellbore intervention system of claim 1, wherein the plurality of ports are spaced substantially equidistantly along the length of the tube.

3. The wellbore intervention system of claim 1, wherein the tube can withstand an internal fluid pressure of up to about 70 kPa.

4. The wellbore intervention system of claim 1, wherein the one-way valve comprises a surface protection plug.

5. The wellbore intervention system of claim 1, further comprising a centralizer that surrounds the first fluid conduit, surrounds the outer surface of the casing string, and is configured to press the first fluid conduit against the outer surface of the casing string.

6. The wellbore intervention system of claim 1, further comprising the remedial substance.

7. The wellbore intervention system of claim 6, wherein the remedial substance comprises cement.

8. A method of repairing a cement failure within a wellbore, the method comprising:

installing a first fluid conduit to an outer surface of a first casing string, the first fluid conduit comprising a tube, a port arranged along the tube, and a one-way valve;

installing one or more second fluid conduits to the outer surface of the first casing string, wherein the first fluid conduit and the one or more second fluid conduits are spaced apart around the outer surface of the first casing string;

running the first casing string, equipped with the first fluid conduit and the one or more second fluid conduits, in a downhole direction through a second casing string installed at the wellbore;

detecting a casing-to-casing annulus (CCA) pressure between the first and second casing strings, the CCA pressure being indicative of the cement failure; and flowing a remedial substance through the first fluid conduit and out of the port to deliver the remedial substance to the cement failure.

9. The method of claim 8, wherein the first fluid conduit comprises one or more additional ports.

10. The method of claim 8, wherein the tube can withstand an internal fluid pressure of up to about 70 kPa.

11. The method of claim 8, further comprising preventing a reservoir fluid at the cement failure from flowing in an uphole direction through the tube.

* * * * *